US009240637B2

(12) United States Patent
Lu et al.

(10) Patent No.: US 9,240,637 B2
(45) Date of Patent: Jan. 19, 2016

(54) HIGH DENSITY TERMINAL BLOCK

(75) Inventors: Hao Lu, Pudong New District (CN); Tong Xu, Pudong New District (CN); Jiuhong Geng, Pudong New District (CN)

(73) Assignee: SCHNEIDER ELECTRIC IT CORPORATION, West Kingston, RI (US)

( * ) Notice: Subject to any disclaimer, the term of this patent is extended or adjusted under 35 U.S.C. 154(b) by 0 days.

(21) Appl. No.: 14/366,765

(22) PCT Filed: Dec. 23, 2011

(86) PCT No.: PCT/CN2011/084565

§ 371 (c)(1),
(2), (4) Date: Jun. 19, 2014

(87) PCT Pub. No.: WO2013/091247

PCT Pub. Date: Jun. 27, 2013

(65) Prior Publication Data

US 2014/0335740 A1 Nov. 13, 2014

(51) Int. Cl.

| | |
|---|---|
| ***H01R 9/24*** | (2006.01) |
| ***H01R 13/46*** | (2006.01) |
| ***H01R 13/62*** | (2006.01) |
| ***H01R 43/18*** | (2006.01) |
| ***H01R 43/26*** | (2006.01) |

(52) U.S. Cl.

CPC ..... *H01R 9/2408* (2013.01); *H01R 9/2416* (2013.01); *H01R 13/46* (2013.01); *H01R 13/62* (2013.01); *H01R 43/18* (2013.01); *H01R 43/26* (2013.01); *Y10T 29/49174* (2015.01)

(58) Field of Classification Search

USPC ..... 439/715, 717, 810, 811, 814, 798

See application file for complete search history.

(56) References Cited

U.S. PATENT DOCUMENTS

| | | | | | |
|---|---|---|---|---|---|
| 4,070,086 | A | * | 1/1978 | Trafford | 439/717 |
| 4,603,376 | A | * | 7/1986 | Maier | 361/824 |
| 4,940,431 | A | * | 7/1990 | Hennemann | 439/716 |
| 5,149,278 | A | * | 9/1992 | Waas et al. | 439/412 |
| 5,273,449 | A | * | 12/1993 | Mattis et al. | 439/201 |
| 5,836,791 | A | * | 11/1998 | Waas et al. | 439/709 |
| 5,848,913 | A | * | 12/1998 | Ashcraft | 439/521 |

(Continued)

FOREIGN PATENT DOCUMENTS

| | | | |
|---|---|---|---|
| CN | 201392894 | Y | 1/2010 |
| CN | 101764293 | A | 6/2010 |

(Continued)

OTHER PUBLICATIONS

International Search Report from corresponding PCT/CN2011/084565 dated Oct. 4, 2012.

*Primary Examiner* — Alexander Gilman

(74) *Attorney, Agent, or Firm* — Lando & Anastasi LLP

(57) ABSTRACT

A module of a terminal block (100) comprises a body (104) having an input configured to be coupled to an input wire and an output configured to be coupled to a plurality of output wires, a conductive element disposed within the input, and a plurality of terminals, each terminal having a first portion and a second portion configured to be coupled to an output wire, wherein the first portions of the plurality of terminals are nested together to achieve a single conductive structure, and wherein the conductive element is configured to engage and compress the input wire against the single conductive structure.

18 Claims, 6 Drawing Sheets

(56) References Cited

U.S. PATENT DOCUMENTS

| | | | | |
|---|---|---|---|---|
| 6,188,560 | B1 * | 2/2001 | Waas | 361/119 |
| 6,210,239 | B1 * | 4/2001 | Harting et al. | 439/814 |
| 6,368,162 | B1 * | 4/2002 | Reetz et al. | 439/723 |
| 6,443,783 | B1 * | 9/2002 | Beadle | 439/814 |
| 6,663,443 | B1 * | 12/2003 | Smith et al. | 439/811 |
| 6,764,354 | B2 * | 7/2004 | Kaine et al. | 439/793 |
| 6,971,926 | B1 * | 12/2005 | Walton | 439/798 |
| 7,234,961 | B2 * | 6/2007 | Arlitt et al. | 439/410 |
| 7,404,745 | B1 * | 7/2008 | Wu | 439/811 |
| 7,833,047 | B2 * | 11/2010 | Pizzi | 439/441 |
| 7,946,896 | B2 * | 5/2011 | Waltz | 439/810 |
| 8,784,142 | B2 * | 7/2014 | Golen | 439/810 |

FOREIGN PATENT DOCUMENTS

| | | | |
|---|---|---|---|
| CN | 202019055 | U | 10/2011 |
| JP | 2000-222996 | A | 8/2000 |

* cited by examiner

HIGH DENSITY TERMINAL BLOCK

This application is a U.S. National Stage Application under 35 U.S.C. §371 from International Application No. PCT/CN2011/084565, filed Dec. 23, 2011, which is hereby incorporated by reference in its entirety for all purposes.

BACKGROUND OF THE INVENTION

1. Field of the Invention

Embodiments of the present invention are directed to a high density terminal block with a low profile and compact assembly.

2. Discussion of Related Art

Electronic systems, such as uninterruptible power supplies, generally include terminal blocks to facilitate connection between two groups of wires. It is common to use DIN terminal blocks with terminals that are fixed to the electronic system and whereby electrical connections to the electronic system are made.

BRIEF SUMMARY OF THE INVENTION

Aspects in accord with the present invention are directed to a module of a terminal block, the module comprising a body having an input configured to be coupled to an input wire and an output configured to be coupled to a plurality of output wires, a conductive element disposed within the input, and a plurality of terminals, each terminal having a first portion and a second portion configured to be coupled to an output wire, wherein the first portions of the plurality of terminals are nested together to achieve a single conductive structure, and wherein the conductive element is configured to engage and compress the input wire against the single conductive structure.

According to one embodiment, the body of the module further has an opening configured to receive the at least one input wire and a hoop having an internal chamber configured to communicate with the opening and to receive the at least one input wire. According to another embodiment, the body of the module further has a cavity and wherein the first portions of the plurality of terminals are located within the cavity.

According to one embodiment, the single conductive structure includes the first portions of the plurality of terminals which are folded onto one another to form a substantially flat contact surface. According to another embodiment, at least two of the plurality of terminals are constructed from a same piece of conductive material. In one embodiment, at least one of the plurality of terminals is configured to be coupled to a quick connector.

According to one embodiment, the module further comprises a bracket coupled to the body of the module, wherein the bracket is configured to be coupled to a DIN rail. In another embodiment, the conductive element includes a screw, and wherein the conductive element is configured to be depressed into the interior chamber when the screw is turned.

According to another embodiment, the opening is configured to receive an input wire with a size of 12 AWG to 4 AWG. In one embodiment, the plurality of terminals are configured to be coupled to an output wire with a size of 20 AWG to 10 AWG. In another embodiment, the plurality of terminals includes four terminals.

According to another aspect, the present invention is directed to a method for coupling an input wire to a plurality of output wires, the method comprising providing a terminal block, providing a module within the terminal block, the module having a body including an input configured to be coupled to the input wire and an output configured to be coupled to the plurality of output wires, providing a conductive element within the input, and providing a plurality of terminals, each terminal having a first portion and a second portion configured to be coupled to an output wire, providing a single conductive structure, the single conductive structure comprised of nested first portions, inserting the input wire into the input, compressing the input wire against the single conductive structure with the conductive element, and coupling each one of the plurality of output wires to one of the plurality of terminals.

According to one embodiment, providing the single conductive structure includes providing a substantially flat contact surface that includes the first portions of the plurality of terminals folded on top of one another. In another embodiment, providing the plurality of terminals includes providing at least two terminals that are constructed from a same piece of conductive material.

According to another embodiment, coupling each one of the plurality of output wires includes coupling at least one of the plurality of output wires to one of the plurality of terminals with a quick connector. In one embodiment, the method further comprises coupling the terminal block to a DIN rail. In another embodiment, the method further comprises providing a screw within the conductive element, and tightening the screw to depress the conductive element and compress the input wire against the single conductive structure.

According to one aspect, the present invention features a terminal block comprising a plurality of modules, the modules coupled together and each module comprising a body having an input configured to be coupled to an input wire and an output configured to be coupled to a plurality of output wires, a conductive element disposed within the input, a plurality of terminals, each configured to be coupled to an output wire, and means for coupling the input wire to the plurality of terminals via a single point of contact.

According to one embodiment, the plurality of modules includes four modules and the plurality of terminals includes four terminals. In another embodiment, the terminal block has a width of about 50 mm, a height of about 40 mm and a length of about 51 mm.

BRIEF DESCRIPTION OF THE DRAWINGS

The accompanying drawings are not intended to be drawn to scale. In the drawings, each identical or nearly identical component that is illustrated in various FIGS. is represented by a like numeral. For purposes of clarity, not every component may be labeled in every drawing. In the drawings.

DETAILED DESCRIPTION OF THE INVENTION

Figure 1:
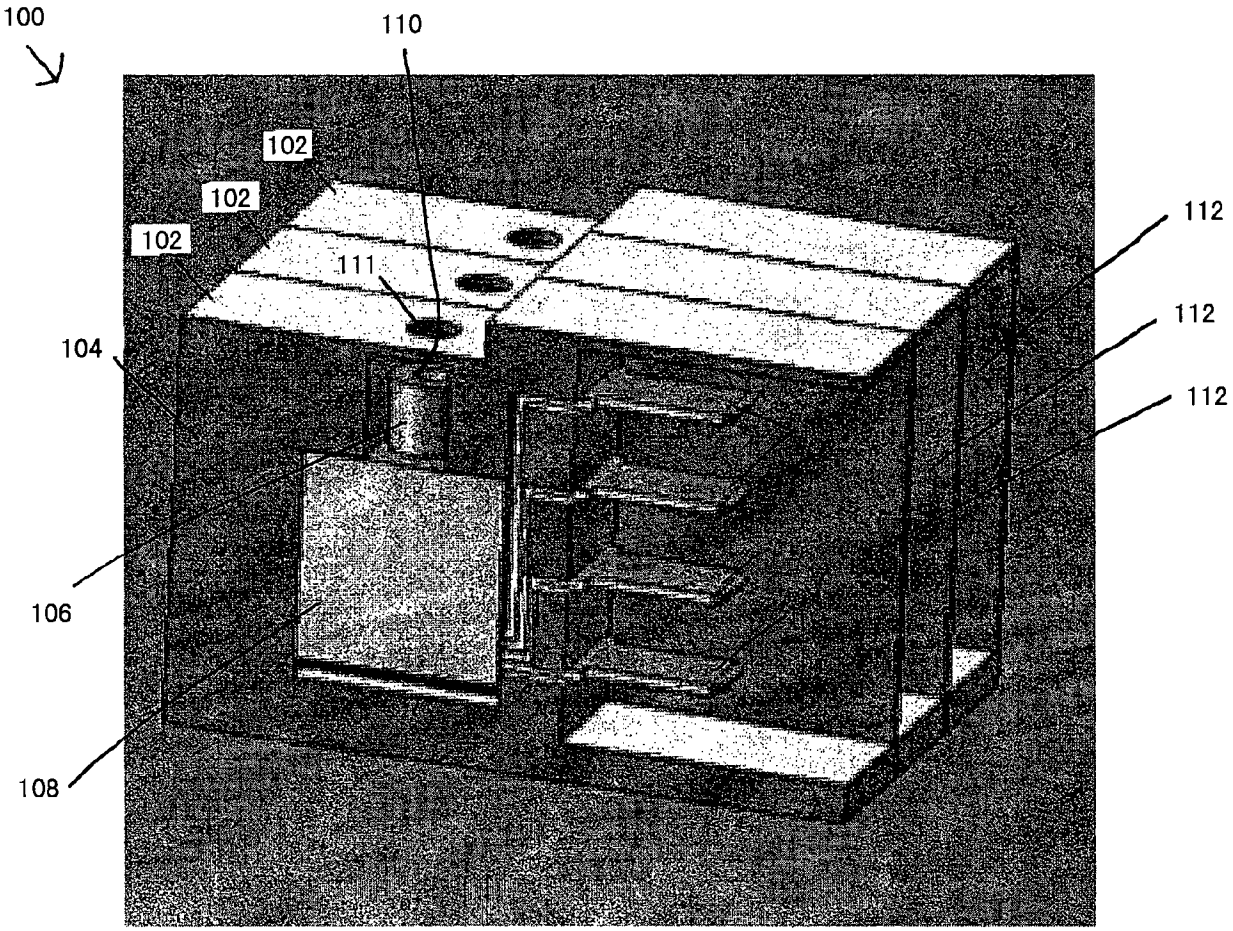
FIG. 1 illustrates a perspective view of a low profile terminal block in accordance with aspects of the present invention.

Embodiments of the invention are not limited to the details of construction and the arrangement of components set forth in the following description or illustrated in the drawings. Embodiments of the invention are capable of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

As described above, within certain electronic systems, terminal blocks are used to facilitate connection between two groups of wires. In some electronic systems, the terminal block may be disposed in a position that is space constrained. In such a constrained space, multiple wire connections can be made, but the connections may require difficult manual intervention by a user or an electrician, who must clamp, screw in, insert, or punch down a wire to achieve connection. In larger systems, a higher quantity of wires along with less flexible and larger gauge wire is required to complete electrical connections. This may increase the difficulty for an electrician to connect the wires, since the space in which the terminal block is positioned remains relatively small, despite the increase in wire size. Further, it is often the case that setup of an electrical system requires use of a tool to complete installation. Use of such tools in a confined space may be necessary for proper connections, but difficult to manipulate by a user.

Therefore, embodiments described herein provide a high density, high voltage terminal block with a low profile and relatively small size requirements, which is relatively easy to wire.

Figure 2:
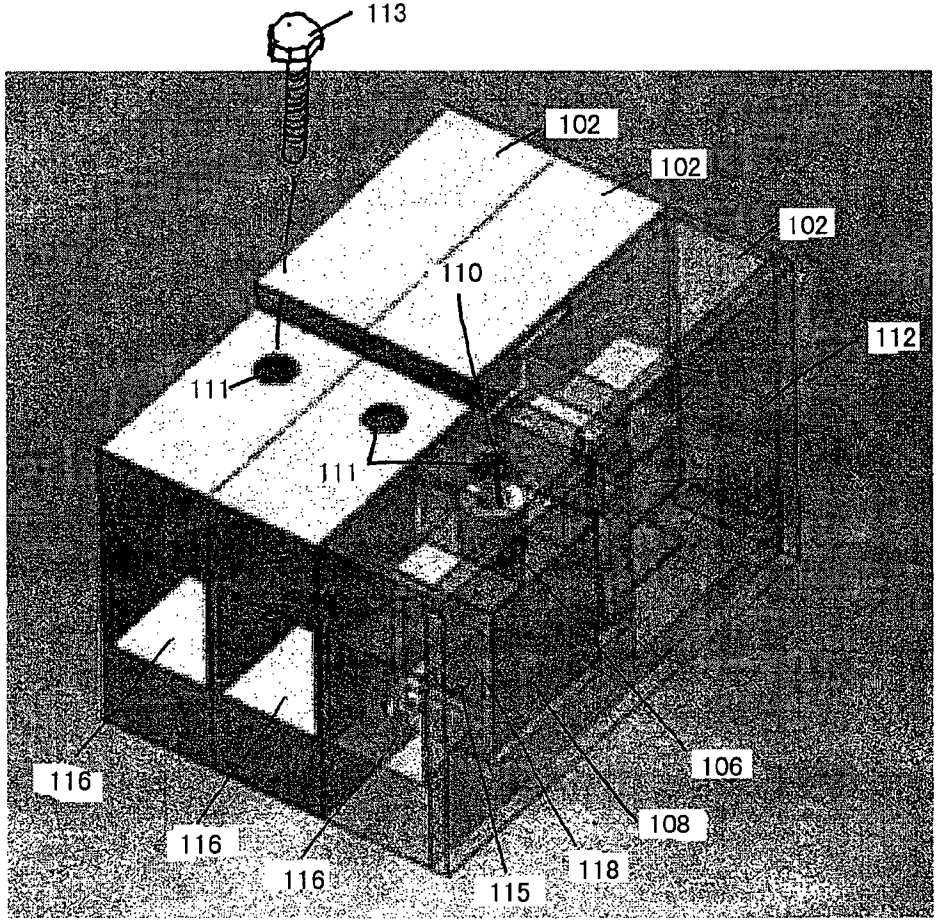
FIG. 2 is a semi-transparent perspective view of a low profile terminal block in accordance with aspects of the present invention.

For example, FIGS. 1 and 2 illustrate one embodiment of a low profile terminal block generally indicated at 100. The terminal block 100 includes a plurality of modules, each indicated at 102. As illustrated, although the terminal block 100 includes three modules 102; in other embodiments, the terminal block 100 may include any number of modules 102 depending on the number of wires desired to be connected together. Each module 102 includes a body 104. Within the body 104 is a stud 106 which is coupled to a hoop 108. The stud 106 passes through the hoop 108 into an interior chamber 118 of the hoop 108. In one embodiment, the body 104 also includes a screw hole 111 and the stud 106 also includes a screw hole 110 which are both configured to allow a screw 113 to be inserted through the holes 110, 111 and threaded through the stud 106.

The body 104 of the module 102 further includes an opening 116 formed in a side of the body, which is openly coupled to the interior chamber 118 of the hoop 108 and is configured to receive an external wire. According to one embodiment, the opening 116 is configured to receive a relatively large wire (e.g., a wire size in the range of 4 American Wire Gauge (AWG) to 12 AWG); however, in other embodiments, the opening 116 may be configured to receive any size wire.

The body 104 also includes a cavity 112, which is located at an end of the body. Within the cavity 112 is a plurality of terminals, each indicated at 114, each being configured to be connected to an external wire. Each terminal 114 extends from the cavity 112 towards the hoop 108 and into the internal chamber 118 of the hoop 108. The terminals 114 are nested together within the internal chamber 118 to form a single conductive structure (e.g., a single contact surface designated by 115), which is electrically coupled to each one of the terminals 114.

According to one embodiment, each terminal 114 is configured to be coupled to a relatively small wire (e.g., a wire size in the range of 10 AWG to 20 AWG); however, in other embodiments, each terminal 114 may be configured to receive any size wire. Also, according to one embodiment, each terminal 114 is configured to be coupled to a wire with an end of a quick connector; however, in other embodiments, any other type of connector may be used. A quick connector is any connector which allows a user to couple and decouple the connector to a terminal absent the use of a tool. For example, in one embodiment, a small wire with a female quick connector end may be pressed onto a terminal 114. The terminal 114 is inserted into the quick connector end until the terminal 114 is encompassed by the quick connector end and compressed against contacts within the quick connector which are electrically coupled to the small wire. Hence, the terminal 114 is electrically coupled to the small wire by merely pressing the connector against the terminal 114 and absent the use of a tool.

As illustrated, the cavity 112 includes four terminals 114; however, in other embodiments, the cavity 112 may include any number of terminals 114 depending on the number of wires desired to be connected to the wire inserted in the opening 116.

When connection of at least two sets of wires through the terminal block 100 is desired, a user may input a large wire through the opening 116 and into the interior chamber 118. The user tightens a screw 113 within the stud 106 which results in the stud moving downward and compressing the inserted large wire against the single contact surface 115 within the internal chamber 118 of the hoop 108 (thereby coupling the large wire to each one of the terminals 114). A user also may connect desired small wires to any of the terminals 114 within the cavity 112. For example, where wires include quick connector ends, a user may push a female quick connector end of a wire onto the desired terminal until the female end is secured around the terminal 114. In this way, the inserted large wire is coupled to each one of the inserted small wires. Furthermore, if a large wire is inserted into the opening 116 of each module 102, and a small wire is coupled to every terminal 114 within each module 102, the capability exists within the low profile terminal block 100 to couple three large wires to twelve small wires.

Figure 3:
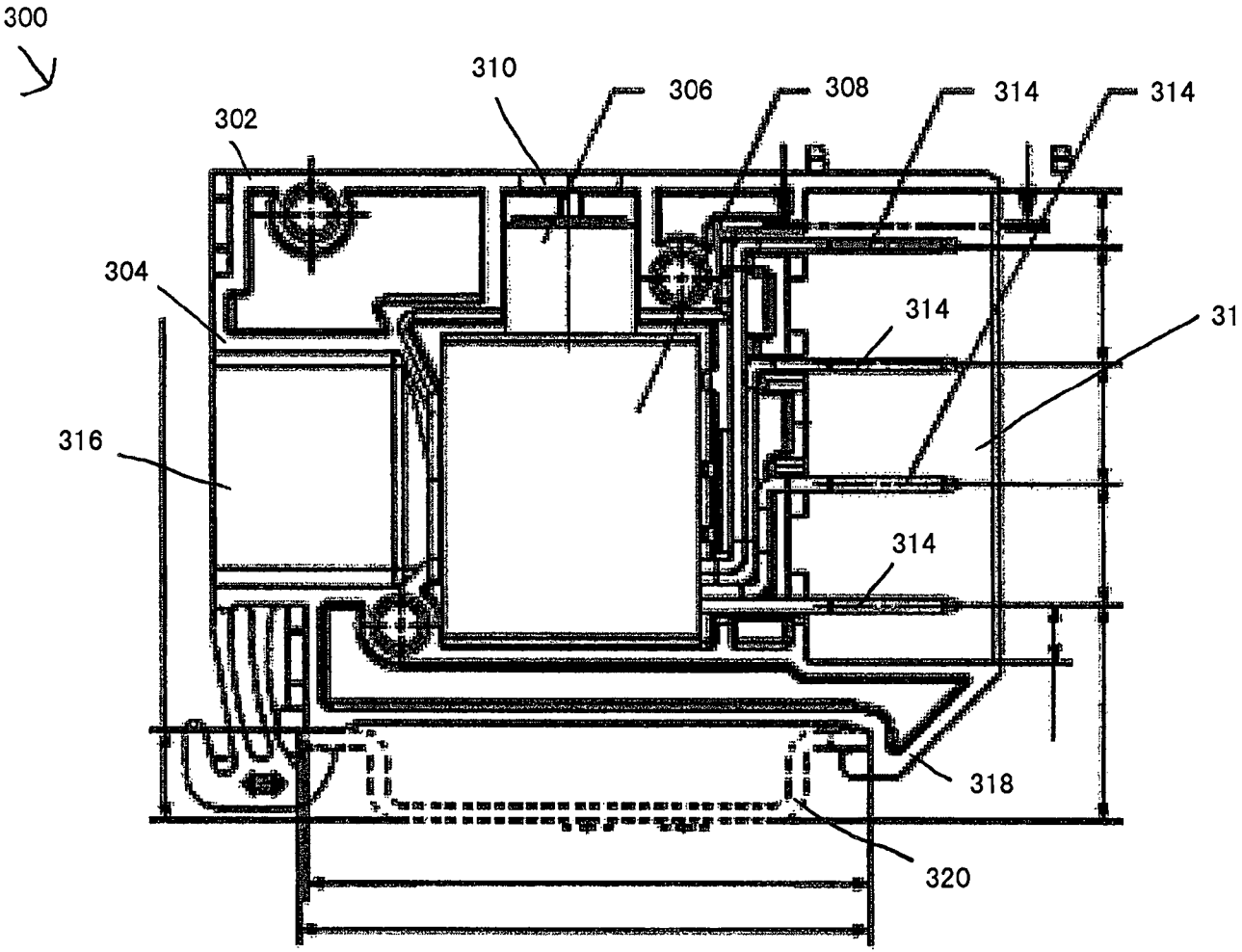
FIG. 3 is a schematic side view of a terminal block in accordance with aspects of the present invention.

FIG. 3 illustrates a side-view schematic diagram of another embodiment of a low profile terminal block 300. The terminal block 300 is similar to the terminal block 100 described above. As illustrated in FIG. 3, only one module 302 of the terminal block 300 is shown; however, the module 302 may be coupled to any number of similar modules 302 (e.g., as similarly shown with regards to modules 102 of terminal block 100 shown in FIGS. 1 and 2).

The module 302 includes a body 304. Within the body 304 is a stud 306, which is coupled to a hoop 308. The stud 306 passes through the hoop 308 into an interior chamber (not shown) of the hoop 308. The stud 306 is also coupled to a screw 310, which is threaded through the stud 306. The body 304 includes an opening 316, which is openly coupled to the interior chamber of the hoop 308. In one embodiment, the opening 316 is configured to receive a relatively large external wire; however, in other embodiments, the opening 316 may be configured to receive any size wire. The body 304 also includes a cavity 312. Within the cavity 312 is a plurality of terminals, each indicated at 314. Each terminal 314 extends from the cavity 312 towards the hoop 308 and into the internal chamber of the hoop 308. The terminals 314 are nested together within the internal chamber to form a single conductive structure (not shown) which is electrically coupled to each one of the terminals 314.

According to one embodiment, each terminal 314 is configured to be connected to a relatively small external wire; however, in other embodiments, each terminal 314 may be configured to be coupled to any size wire. Also, according to another embodiment, each terminal 314 is configured to be coupled to a wire with a quick connector end; however, in other embodiments, any other type of connector may be used. As illustrated, the cavity 312 includes four terminals 314; however, in other embodiments, the cavity 312 may include any number of terminals 314 depending on the number of wires desired to be connected to the wire inserted in the opening 316.

In addition, the module 302 also includes a bracket 318. In one embodiment, the bracket 318 is configured to couple the module 302 to a DIN rail 320. The DIN rail 320 is coupled to a desired location within an electronic system.

When connection of at least two sets of wires through the terminal block 300 is desired, a user may input a large wire through the opening 316 and into the interior chamber (within the hoop 308). The user tightens the screw 310 within the stud 306 which results in the stud 306 moving downward and compressing the inserted large wire against the single conductive structure within the hoop 308 (thereby coupling the large wire to each one of the terminals 314). A user also may connect desired small wires to any of the terminals 314 within the cavity 312. For example, where wires include quick connectors, a user may push the quick connectors of each wire onto the desired terminal until the wire is secured to the terminal 314. In this way, the inserted large wire is coupled to each one of the inserted small wires.

Figure 4:
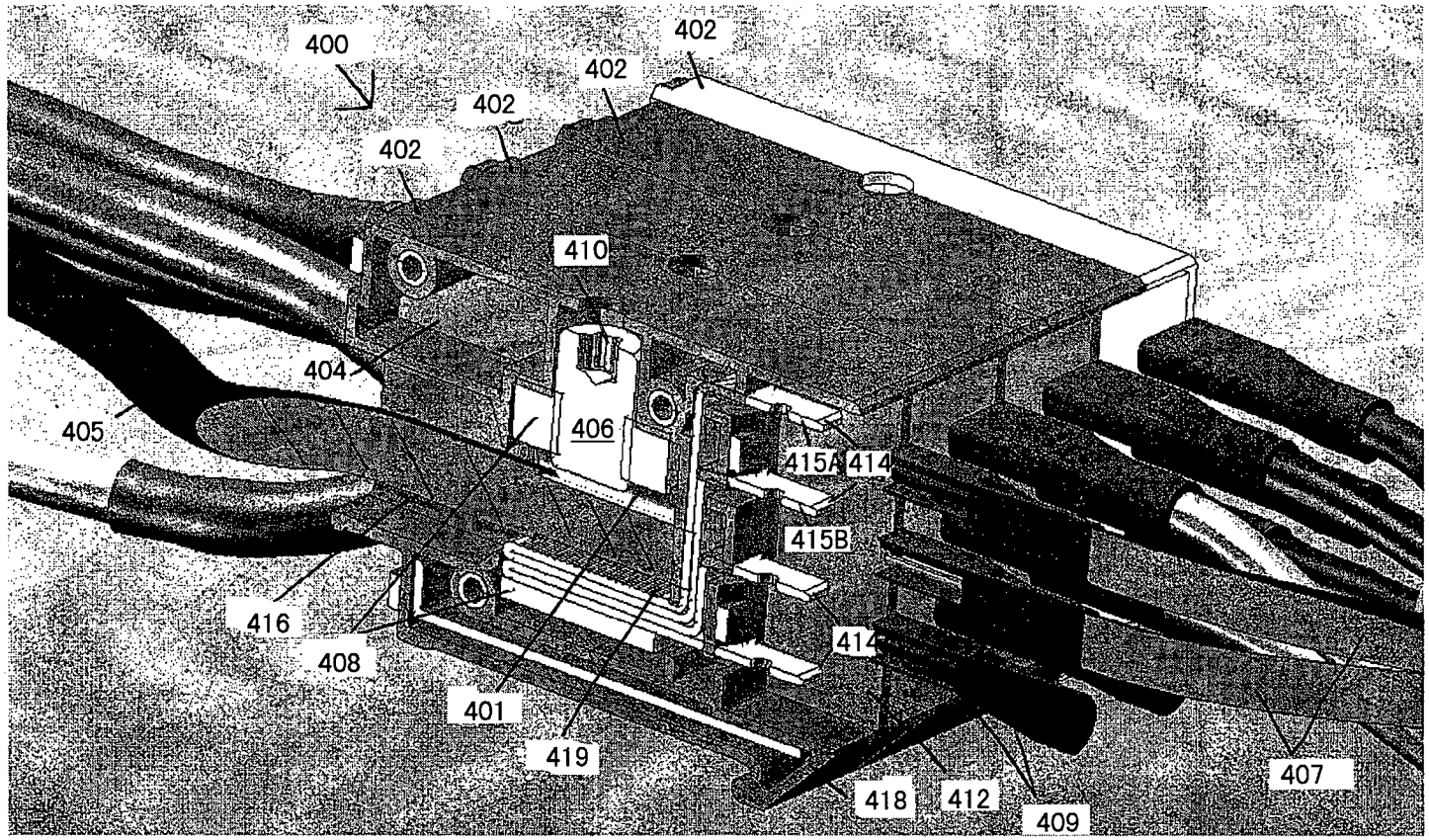
FIG. 4 illustrates a pre-connection perspective, partial cross-sectional view of a terminal block in accordance with aspects of the present invention.
Figure 5:
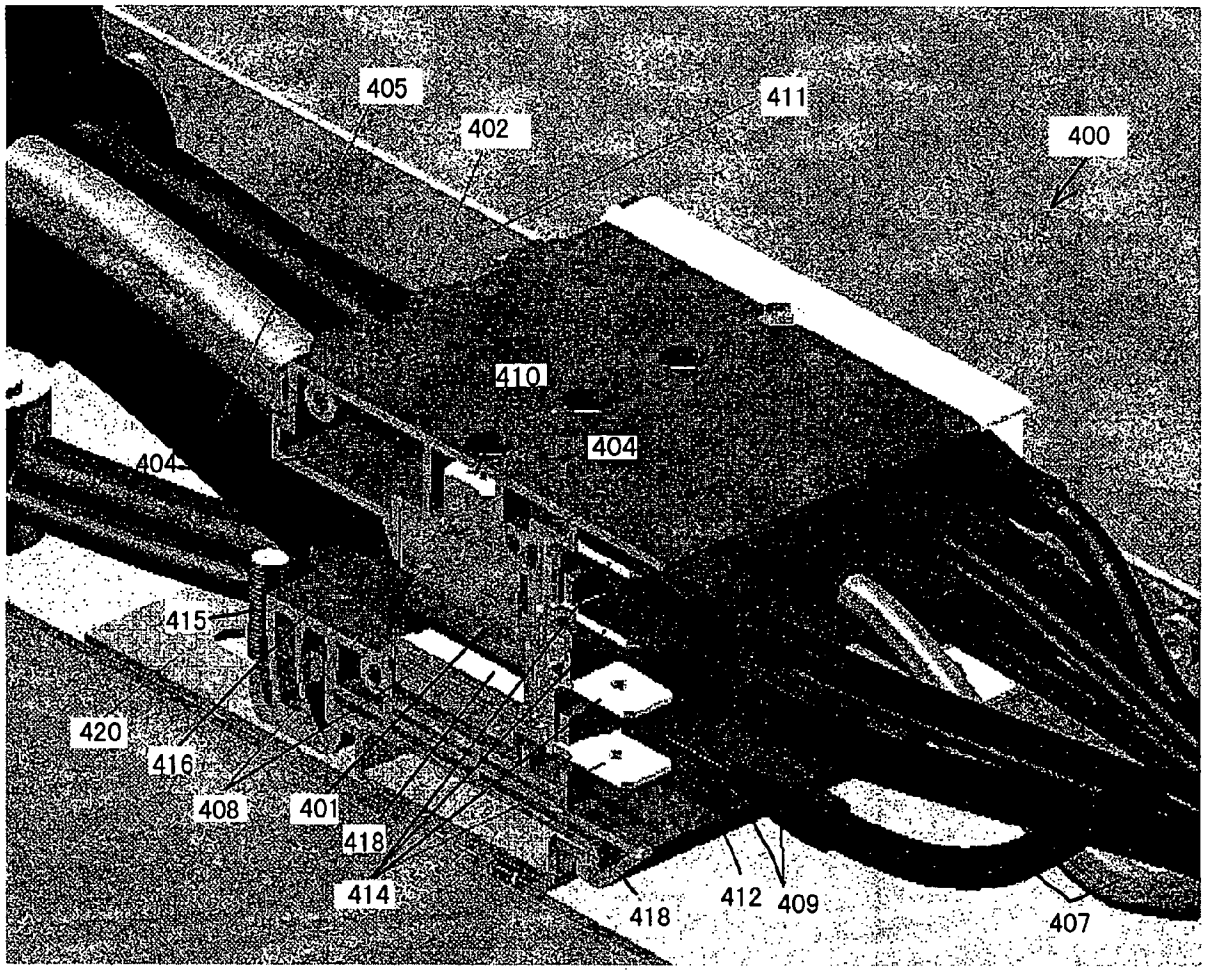
FIG. 5 illustrates a post-connection perspective, partial cross-sectional view of a terminal block in accordance with aspects of the present invention.

FIGS. 4 and 5 illustrate partial cross-sectional views of a terminal block 400. FIG. 4 illustrates the terminal block 400 prior to the connection of wires to an end cavity 412 and FIG. 5 illustrates the terminal block 400 post-connection. As illustrated, the terminal block 400 includes four modules 402; however, in other embodiments, the terminal block may include any number of modules 402.

Each module 402 includes a body 404. Within the body 404 is a stud 406 which is coupled to a hoop 408. The stud 406 passes through the hoop 408 into an interior chamber 401 of the hoop 408. The stud 406 is also coupled to a screw 410, which is threaded through the stud 406. The body 404 includes an opening 416 which is openly coupled to the interior chamber 401 of the hoop 408. In one embodiment, the opening 416 is configured to receive a relatively large external wire 405; however, in other embodiments, the opening 416 may be configured to receive any size wire. According to one embodiment, the large external wire 405 is coupled to the terminal block 400 with a current transformer (not shown).

The body 404 also includes a cavity 412. Within the cavity 412 is a plurality of terminals, each indicated at 414. The plurality of terminals 414 are comprised of conductive material (e.g., copper, copper alloy, or any other type of conductive material). Each terminal 414 extends from the cavity 412 towards the hoop 408 and into the internal chamber 401 of the hoop 408. The terminals 414 are nested together within the internal chamber 401 to form a single conductive structure (e.g., a single contact structure or element 419), which is electrically coupled to each one of the terminals 414.

According to one embodiment, and as illustrated in FIGS. 4 and 5, the terminals 414 are nested within the internal chamber 401 by folding the terminals 414 onto one another so that the terminals 414 lay substantially flat against each other and form a single conductive structure having the surface of one of the terminals 414 (i.e. a single contact surface 419) adjacent the interior chamber 401. Therefore, when a wire is in electrical connection with the single contact surface 419 (i.e. the surface of one terminal 414), it is also in electrical connection with all of the terminals 414. In this way, size and connection requirements within the terminal block 400 may be reduced.

According to another embodiment, the same piece of conductive material may comprise more than one terminal 414. For example, as illustrated in FIGS. 4 and 5, a first end of a piece of conductive material 415A comprises a first terminal 414. The piece of conductive material 415A extends into the interior chamber 401, is folded back onto itself towards the cavity 412, and also includes a second end 415B which extends into the cavity 412 and comprises a second terminal 414. By limiting the individual pieces of conductive material, the terminal block 400 may have reduced size and connection requirements. In other embodiments, any appropriate number of conductive material pieces may be utilized to form the terminals 414.

According to one embodiment, each terminal 414 is configured to be connected to a relatively small external wire, each indicated at 407; however, in other embodiments, each terminal 414 may be configured to be coupled to any size wire. Also, according to another embodiment, each terminal 414 is configured to be coupled to a wire with a quick connector end 409; however, in other embodiments, any other type of connector may be used. As illustrated, the cavity 412 includes four terminals 414; however, in other embodiments, the cavity 412 may include any number of terminals 414 depending on the number of wires desired to be connected to the wire inserted in the opening 416.

In addition, the module 402 also includes a bracket 418. In one embodiment, the bracket 418 is configured to couple the module 402 to a support structure, such as a DIN rail 420. According to one embodiment, the DIN rail 420 is coupled to a chassis 411 within an electronic system. In one embodiment, the DIN rail 420 is coupled to the chassis with a bolt 415. In other embodiments, the DIN rail 420 may be coupled to any other appropriate location within an electronic system. Also, in other embodiments, the bracket 418 may be configured to couple the module 402 to any other type of support structure within an electronic system.

When connection of at least two sets of wires through the terminal block 400 is desired, a user inputs a large wire 405 through the opening 416 and into the interior chamber 401. The user tightens a screw 410 within the stud 106 which results in the stud moving downward and compressing the inserted large wire 405 against the single contact surface 419 within the internal chamber 118 of the hoop 108 (thereby coupling the large wire to each one of the terminals 414). A user also may connect desired small wires 407 to any of the terminals 414 within the cavity 412. For example, where wires include quick connector ends 409, a user may push a female quick connector end 409 of a wire onto the desired terminal 414 until the female end 409 is secured around the terminal 114. In this way, the inserted large wire 405 is coupled to each one of the inserted small wires 407. Furthermore, if a large wire is inserted into the opening 416 of each module 402, and a small wire 407 is coupled to every terminal 414 within each module 402, the capability exists within the low profile terminal block 400 to couple four large wires to sixteen small wires.

Figure 6:
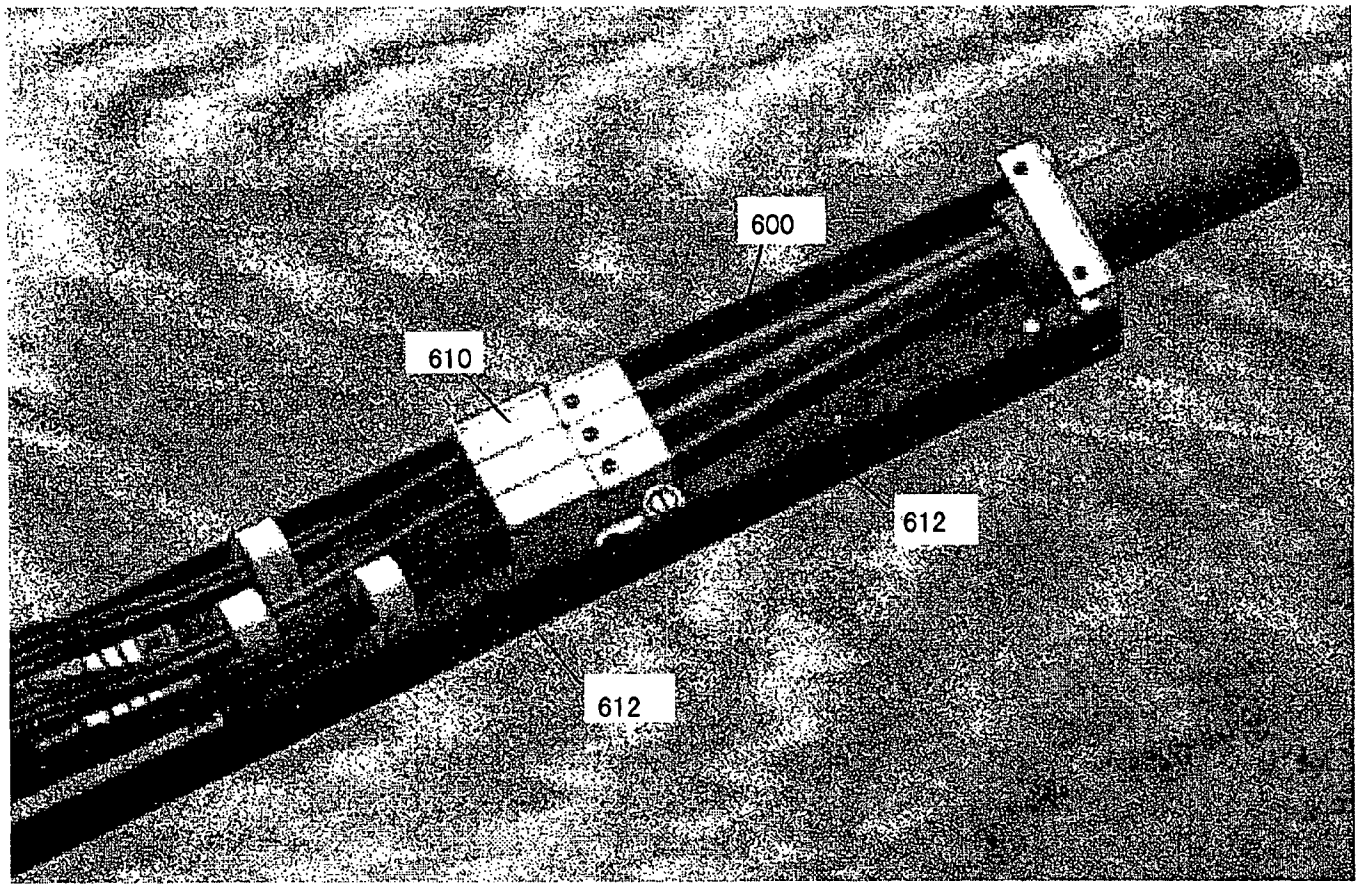
FIG. 6 illustrates a perspective view of a terminal block coupled to a chassis in accordance with aspects of the present invention.

As illustrated in FIG. 6, a terminal block 610 (similar to the terminal blocks 100, 300 and 400 described above) is coupled within a chassis 600. As can be seen in FIG. 6, the space within the chassis 600 is constrained, potentially resulting in difficult conditions with regards to the installation and maintenance of wires 612 within the terminal block 610. However, as described above, the terminal block 610 may have reduced space and connection requirements due to the use of a single conductive structure (e.g., the nesting of terminals) to connect two groups of wires. For example, in one embodiment, the terminal block 610 has a width of about 50 mm, a height of about 40 mm and a length of about 51 mm; however, in other embodiments, the terminal block 610 may have different size requirements.

As described herein, the terminals are constructed of a conductive material (e.g., copper, copper alloy, or any other conductive material); however, in other embodiments, additional portions of the terminal block may also be constructed of a conductive material. For example, in one embodiment, the hoop and/or stud are also made of a conductive material.

Also as described herein, the terminal blocks include modules which connect one large wire to four smaller wires. However, in other embodiments, a module may be configured to connect a large wire to any number of smaller wires. For example, a module may be configured to connect one large wire to two smaller wires, one large wire to three smaller wires, or one large wire to eight smaller wires. Any number and size of wires may be utilized in a low profile terminal block.

As described herein, the terminal block is coupled to electronic system with a DIN rail; however, in other embodiments, a terminal block may be coupled to an electronic system with any appropriate method. For example, in one embodiment, screw fasteners may be used to couple a terminal block to a desired location within an electronic system.

As described herein, the wire input into the internal chamber is relatively at the same angle as the wires coupled to the terminals. However, in other embodiments, the terminals may be configured so that the wire input into the internal chamber is at a different relative angle than the wires coupled to the terminals. For example, the terminals may be configured so that wires coupled to the terminals are at a 45 or 90 degree angle relative to the wire input into the internal chamber. However, in other embodiments, the terminals may be configured to locate the wires at any different angle depending on the space within which the terminal block is installed.

As described herein, by nesting terminals together to form a single conductive structure, a high density, high voltage terminal block with a low profile and relatively small size requirements is provided. In addition, size and connection requirements may also be reduced by using the same piece of conductive material for multiple terminals. Finally, by utilizing such connection methods as quick connectors and screw connectors, the ease by which a user can connect cables to a terminal block, despite a constrained space, may be improved.

Having thus described at least one illustrative embodiment of the invention, various alterations, modifications and improvements will readily occur to those skilled in the art. Such alterations, modifications and improvements are intended to be within the scope and spirit of the invention. Accordingly, the foregoing description is by way of example only and is not intended as limiting. The invention's limit is defined only in the following claims and the equivalents thereto.

What is claimed is:

1. A module of a terminal block, the module comprising:

a body having an input configured to be coupled to an input wire and an output configured to be coupled to a plurality of output wires;

a conductive element disposed within the input; and a plurality of terminals, each terminal having a first portion and a second portion configured to be coupled to an output wire, wherein the first portions of the plurality of terminals are nested together to achieve a single conductive structure that includes the first portions of the plurality of terminals folded onto one another to form a substantially flat contact surface, and wherein the conductive element is configured to engage and compress the input wire against the single conductive structure.

2. The module of claim 1, wherein the body of the module further has an opening configured to receive the at least one input wire and a hoop having an internal chamber configured to communicate with the opening and to receive the at least one input wire.

3. The module of claim 1, wherein the body of the module further has a cavity and wherein the first portions of the plurality of terminals are located within the cavity.

4. The module of claim 1, wherein at least two of the plurality of terminals are constructed from a same piece of conductive material.

5. The module of claim 1, wherein at least one of the plurality of terminals is configured to be coupled to a quick connector.

6. The module of claim 1, further comprising a bracket coupled to the body of the module, wherein the bracket is configured to be coupled to a DIN rail.

7. The module of claim 2, wherein the conductive element includes a screw, and wherein the conductive element is configured to be depressed into the interior chamber when the screw is turned.

8. The module of claim 2, wherein the opening is configured to receive an input wire with a size of 12 AWG to 4 AWG.

9. The module of claim 1, wherein the plurality of terminals are configured to be coupled to an output wire with a size of 20 AWG to 10 AWG.

10. The module of claim 1, wherein the plurality of terminals includes four terminals.

11. A method for coupling an input wire to a plurality of output wires, the method comprising:

providing a terminal block;

providing a module within the terminal block, the module having a body including an input configured to be coupled to the input wire and an output configured to be coupled to the plurality of output wires;

providing a conductive element within the input; and providing a plurality of terminals, each terminal having a first portion and a second portion configured to be coupled to an output wire, providing a single conductive structure, the single conductive structure comprised of nested first portions;

inserting the input wire into the input;

compressing the input wire against the single conductive structure with the conductive element; and coupling each one of the plurality of output wires to one of the plurality of terminals, wherein providing the single conductive structure includes providing a substantially flat contact surface that includes the first portions of the plurality of terminals folded on top of one another.

12. The method of claim 11, wherein providing the plurality of terminals includes providing at least two terminals that are constructed from a same piece of conductive material.

13. The method of claim 11, wherein coupling each one of the plurality of output wires includes coupling at least one of the plurality of output wires to one of the plurality of terminals with a quick connector.

14. The method of claim 11, further comprising coupling the terminal block to a DIN rail.

15. The method of claim 11, further comprising:

providing a screw within the conductive element; and tightening the screw to depress the conductive element and compress the input wire against the single conductive structure.

16. A terminal block comprising:

a plurality of modules, the modules coupled together and each module comprising:

a body having an input configured to be coupled to an input wire and an output configured to be coupled to a plurality of output wires;

a conductive element disposed within the input;

a plurality of terminals, each configured to be coupled to an output wire; and means for coupling the input wire to the plurality of terminals via a single conductive structure, the single conductive structure including portions of the plurality of terminals folded onto one another to form a substantially flat contact surface.

17. The terminal block of claim 16, wherein the plurality of modules includes four modules and the plurality of terminals includes four terminals.

18. The terminal block of claim 17, wherein the terminal block has a width of about 50 mm, a height of about 40 mm and a length of about 51 mm.

* * * * *